United States Patent [19]

Longbrake

[11] 4,170,343

[45] Oct. 9, 1979

[54] KNIFE SHARPENER

[76] Inventor: Howard R. Longbrake, R.D. 2, Grafton, Ohio 44044

[21] Appl. No.: 930,747

[22] Filed: Aug. 3, 1978

[51] Int. Cl.[2] ..... B25B 3/00

[52] U.S. Cl. ..... 269/3

[58] Field of Search ..... 269/1-2, 269/3, 6, 87, 87.1, 87.2, 87.3, 321 CF; 76/82, 82.2, 88; 51/173, 221 R, 221 BS, 218 P; 29/76 A

[56] References Cited

U.S. PATENT DOCUMENTS 3,819,170 6/1974 Longbrake ..... 269/3

*Primary Examiner*—Robert C. Watson

*Attorney, Agent, or Firm*—Watts, Hoffmann, Fisher & Heinke Co.

[57] ABSTRACT

A portable work holder for positioning and maintaining an article being sharpened, such as a knife, or the like, in predetermined position relative to a planar surface of a stationary abrasive member or stone during manual manipulation of the article relative to the abrasive member for the purpose of sharpening the same, having two plate-like relatively long narrow clamp members each with one end having a bevel on only one side and pivotally connected by a countersunk head screw to one another adjacent to their bevelled ends with their bevelled sides facing away from one another, a thumb screw threaded in a tapped aperture in one of the clamp members intermediate the pivotal connection of the members to one another and the ends of the clamp members remote from the previously mentioned bevelled ends with its non-headed end engaging the other clamp member for forcing the bevelled ends of the clamp member towards one another, and movable projections of equal length in the form of eye bolts extending a substantial distance from the sides of the clamp members adjacent to their ends other than the aforementioned bevelled ends thereof.

4 Claims, 2 Drawing Figures

KNIFE SHARPENER

BACKGROUND OF THE INVENTION

1. Field of the Invention

The invention relates to portable work holders for use with stationary sharpening stones.

2. Description of the Prior Art

Articles, such as hand knives and the like, are typically sharpened by manually moving them relative to an abrasive member, for example, a sharpening or honing stone, with the cutting edge of the article at an angle to and in contact with the abrasive member. It is difficult, if not impossible, to maintain the desired angular relationship between the article being sharpened and the abrasive member during the sharpening operaiton.

SUMMARY OF THE INVENTION

The present invention provides a simple, inexpensive, novel portable work holder for positioning and maintaining an article being sharpened, such as a knife, or the like, in predetermined position relative to a planar surface of a stationary abrasive member or stone during manual manipulation of the article relative to the abrasive member for the purpose of sharpening the same.

The invention more specifically provides a work holder of the character referred to comprising two clamp members each having one end bevelled on only one side pivotally connected to one another adjacent to their bevelled ends with their bevelled sides facing away from one another, means for forcing the bevelled ends of the clamp members towards one another, and means projecting equal substantial distances from the sides of the clamp members adjacent to the ends thereof other than their previously mentioned bevelled ends.

Further objects and advantages of the invention will be hereinafter referred to or be obvious from the accompanying drawing and following description of the preferred embodiment of the invention depicted in the drawing.

DESCRIPTION OF PREFERRED EMBODIMENT

Figure 1:
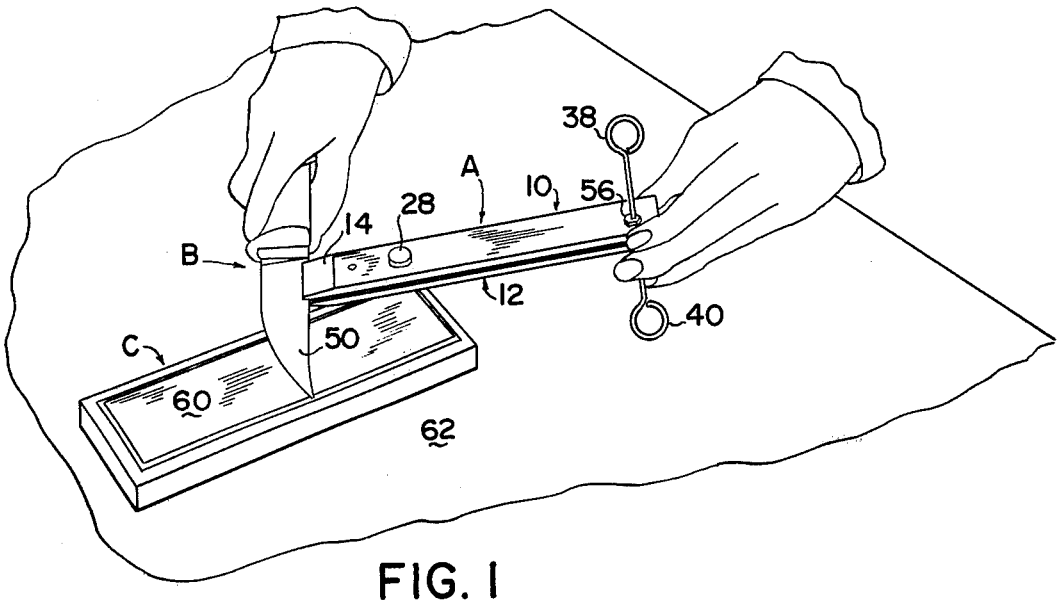
FIG. 1 is a perspective view of an instrument or article work holder embodying the invention as it may be used in sharpening a hunting knife.
Figure 2:
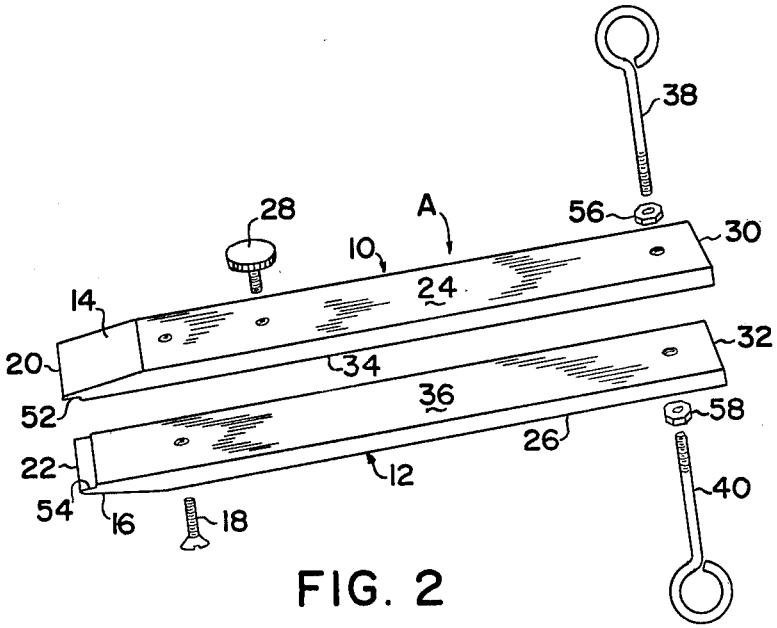
FIG. 2 is an exploded view of the holder shown in FIG. 1.

The work holder depicted in the drawings is designated generally by the reference character A and comprises two platelike relatively long narrow clamp members 10, 12, each having one end bevelled, as indicated by the reference characters 14, 16, respectively, on only one side, means in the form of a countersunk head threaded fastener or screw 18 pivotally connecting the clamp members to one another adjacent to their bevelled ends 20, 22 with their bevelled sides 24, 26 facing away from one another, means in the form of a knurled thumb screw 28 intermediate the fastener 18 and the ends 30, 32 of the clamp members other than the bevelled ends 20, 22 thereof for forcing the adjacent sides 34, 36 of the clamp member 10, 12, respectively, at the bevelled ends of the clamp members towards one another, and means in the form of eye bolts 38, 40 detachably connected to the clamp members 10, 12 adjacent to the ends 30, 32 thereof, respectively, and projecting a substantial distance from the sides 24, 26 of the clamp members 10, 12 facing away from one another.

The shank of the countersunk head screw 18 extends through an aperture in the clamp member 12 which aperture is of slightly larger diameter than that of the shank of the screw and the threaded end of the shank is threaded into a suitably tapped aperture in the clamp member 10. The knurled thumb screw 28 is threaded into a suitable tapped aperture in the clamp member 10 and the projecting end of the screw engages the adjacent side 36 of the clamp member 12. The construction is such that an article, for example, the knife blade, such as the blade 50 of a knife B depicted in FIG. 1, can be readily clamped in the holder A and unclamped by turning the screw 28 in the proper direction.

The clamp ends 20, 22 of the clamp members 10, 12 are preferrably provided with recesses or apertures 52, 54, respectively, facing one another and extending entirely across the ends 20, 22 of the clamp members. The sides of the recesses 52, 54 facing one another are inclined with respect to the sides 34, 36 of the clamp members also facing one another so as to diverge from one another towards the other ends 30, 32 of the clamp members at an angle which is about one half of the included angle of a typical knife blade which is usually about three degrees (3°). In the depicted work holder the surfaces of the recesses 52, 54 facing one another are inclined rearwardly at an angle of about one and one half degrees (1 ½°) to the planes of the side surfaces 34, 36 of the clamp members. The inclination of the faces of the recesses 52, 54 facing one another assures that the midplane of blade 50 of the knife B when clamped therebetween is parallel or essentially parallel with the midplanes between the clamp members 10, 12. The recesses or grooves 52, 54 are relatively narrow so that the work holder can be employed to hold articles which are not tapered.

In the depicted work holder the projections 38, 40 at the ends 30, 32 of the clamp members 10, 12, respectively, are of equal length and are, as previously mentioned, in the form of eye bolts. The eye bolts have their threaded ends threaded into suitable tapped apertures in the clamp members and are fixed to the clamp members by lock nuts 56, 58. The eye bolts are removable from the clamp members so that the work holder is more readily transported from place to place and so that the eye bolts can be replaced by projections of different length, as desired.

In use the article to be sharpened, such as, the blade 50 of the knife B is clamped in the work holder A between the bevelled ends of the clamp members 10, 12 with the cutting edge of the article oriented generally normal to the ends of the clamp member, that is, generally transversely of the length of the work holder. The article is then moved over an abrasive member with the cutting edge in contact with a planar abrasive surface thereof and one of the projectioning parts 38, 40 of the work holder riding on or sliding along a planar surface adjacent to and parallel with the planar surface of the abrasive member contacted by the article being sharpened. In FIG. 1 of the drawings which illustrates one use of the work holder the planar surface of the abrasive device over which the article being sharpened is moved with its cutting edge in contact therewith is the upper surface 60 of a rectangular sharpening stone C resting upon a table top 62 upon which top the free end or headed end of the eye bolt 40 slides thus maintaining the blade 50 of the knife B at a predetermined angle to the abrasive surface 60. After one side of the cutting edge of the article being sharpened is ground to the desired bevel angle and it is necessary or desirable to ground the other side of the cutting edge, the work holder with the article still clamped therein can be turned over and the other side of the cutting edge ground in a similar manner to the same bevel angle. If different bevel angles are desired on opposite sides of the article, projections of different length can be provided on the clamp member, for example, by substituting eye bolts of different length for the eye bolts 38, 40 of the preferred embodiment.

In the depicted work holder the clamp members 10, 12 are each about seven and one half inches (7.5") long, about one inch (1") wide and about one quarter inch (0.25") thick, and the eye bolts 38, 40 project from the clamp members about two and three quarters (2.75") inches. A worker holder of about this size has been found to produce the optimum bevel angle on opposite sides of a knife, such as, the hunting knife B shown when in use with a typical sharpening stone resting on a table top.

While the preferred embodiment of the invention is shown and described in detail it is to be understood that the invention is not limited thereto and can be otherwise embodied. Round head bolts, for example, can be substituted for the eye bolt shown and projection members other than bolts either of fixed or adjustable length may be employed. The invention further contemplates the use of constructions or devices other than those shown to move the clamp members towards one another to clamp an article therebetween. The preferred embodiment, however, is simple in construction, made of readily available material and is inexpensive to manufacture.

It is the intention to patent hereby all modifications and alternative constructions of the preferred embodiment which come within the purview of the appended claims.

I claim:

1. A portable work holder for positioning and maintaining an article being sharpened, such as a knife, or the like, in predetermined position relative to a planar surface of a stationary abrasive member or stone during manual manipulation of the article relative to the abrasive member for the purpose of sharpening the same, comprising two clamp members having opposed planar surfaces and a bevel on the opposite side of each member at one end thereof, means pivotally connecting said clamp members to one another with their bevelled ends adjacent to one another, means for forcing the bevelled ends of said clamp member towards one another, and a member connected to each clamp member and projecting a substantial distance from said bevelled sides of said clamp members adjacent to the ends of said clamp members other than said bevelled ends thereof.

2. A portable work holder for positioning and maintaining an article being sharpened, such as a knife, or the like, in predetermined position relative to a planar surface of a stationary abrasive member or stone during manual manipulation of the article relative to the abrasive member for the purpose of sharpening the same, comprising two plate-like relatively long narrow clamp members facing one another and each having two adjacent ends bevelled on their non-facing sides, means pivotally connecting said clamp members to one another adjacent to their said bevelled ends, means intermediate said first mentioned means and the ends of said clamp members other than said bevelled ends thereof for forcing said bevelled ends of said clamp member towards one another, and a member connected to each clamp member and projecting a substantial distance from said bevelled sides of said clamp members adjacent to the ends of said clamp members other than said bevelled ends thereof.

3. A work holder as claimed in claims 1 or 2 wherein the extension of one or both of said members projecting from the clamp members adjacent to the ends thereof other than the said bevelled ends thereof is adjustable.

4. A work holder as claimed in claims 1, 2 or 3 in which the said bevelled ends of the clamp members are provided with shallow apertures in the sides of the clamp members facing one another which apertures have surfaces facing one another diverging from one another in the direction away from said end of the clamp members.

* * * * *